US011124991B2

(12) United States Patent
Parfitt et al.

(10) Patent No.: US 11,124,991 B2
(45) Date of Patent: Sep. 21, 2021

(54) LOCK FOR A TAMPER RESISTANT ASSEMBLY

(71) Applicant: BAE Systems plc, London (GB)

(72) Inventors: Samuel David Charles Parfitt, Chelmsford (GB); Richard John Harper, Chelmsford (GB); Thomas Mark Plucinski, Chelmsford (GB)

(73) Assignee: BAE Systems plc, London (GB)

( * ) Notice: Subject to any disclaimer, the term of this patent is extended or adjusted under 35 U.S.C. 154(b) by 519 days.

(21) Appl. No.: 16/315,471

(22) PCT Filed: Jul. 10, 2017

(86) PCT No.: PCT/GB2017/052017

§ 371 (c)(1),
(2) Date: Jan. 4, 2019

(87) PCT Pub. No.: WO2018/015714

PCT Pub. Date: Jan. 25, 2018

(65) Prior Publication Data

US 2020/0032552 A1 Jan. 30, 2020

(30) Foreign Application Priority Data

Jul. 18, 2016 (EP) ..... 16179949
Jul. 18, 2016 (GB) ..... 1612401

(51) Int. Cl.
*E05B 51/00* (2006.01)
*E05B 15/16* (2006.01)
*E05B 65/00* (2006.01)

(52) U.S. Cl.
CPC ..... *E05B 51/005* (2013.01); *E05B 15/1635* (2013.01); *E05B 65/006* (2013.01); *E05B 2015/165* (2013.01); *E05Y 2900/602* (2013.01)

(58) Field of Classification Search
CPC .... E05B 51/00; E05B 51/005; E05B 15/1635; E05B 65/006; E05B 2015/165; E05B 17/14; E05B 19/26; E05Y 2900/602
(Continued)

(56) References Cited

U.S. PATENT DOCUMENTS 4,617,448 A 10/1986 Goldowsky
4,869,085 A * 9/1989 Meissner ..... E05B 19/18 70/409

(Continued)

FOREIGN PATENT DOCUMENTS

DE 352950 C 5/1922
EP 247966 A2 12/1987

(Continued)

OTHER PUBLICATIONS

International Preliminary Report on Patentability for Appl No. IDSPCT/GB2017/052017 dated Jan. 22, 2019, 7 pages.

(Continued)

*Primary Examiner* — Suzanne L Barrett
(74) *Attorney, Agent, or Firm* — Maine Cernota & Rardin

(57) ABSTRACT

A tamper-resistant lock assembly comprising a plate having a slot for receiving a key, the slot extending through the plate from an opening in a front face thereof to an exit in an opposing rear face thereof, the opening having a first profile and the exit having a second, different profile, the key comprising a shaft having a bit extending therefrom, the bit being formed of a shape memory material and being pre-configured such that its cross-sectional shape in its temporary form matches the first profile and the bit can be inserted through the slot via the opening and, upon application of a predetermined external stimulus, returns to a permanent form in which its cross-sectional shape matches the second profile and the bit can be retracted from the slot via the exit.

19 Claims, 8 Drawing Sheets

(58) Field of Classification Search
USPC ..... 70/163, 395–399, 402–416
See application file for complete search history.

(56) References Cited

U.S. PATENT DOCUMENTS

| | | | | |
|---|---|---|---|---|
| 7,469,538 | B2 * | 12/2008 | Jung | F16B 1/0014 60/527 |
| 2007/0119164 | A1 | 5/2007 | Jung et al. | |
| 2016/0186459 | A1 * | 6/2016 | Baki | B22D 25/02 70/416 |

FOREIGN PATENT DOCUMENTS

| | | | |
|---|---|---|---|
| JP | H0256271 | U | 4/1990 |
| WO | 99/14504 | A2 | 3/1999 |

OTHER PUBLICATIONS

International Search Report and Written Opinion of International Application No. PCT/GB2017/052017, dated Sep. 6, 2017, 11 pages.
Extended European Search Report of European Patent Application No. EP16179949, dated Jan. 20, 2017, 7 pages.
Search Report under Section 17(5) of Great Britain Patent Application No. GB1612401.8, dated Feb. 10, 2017, 3 pages.

* cited by examiner

LOCK FOR A TAMPER RESISTANT ASSEMBLY

RELATED APPLICATIONS

This application is a National Phase application filed under 35 USC § 371 of PCT Application No. PCT/GB2017/052017 with an International filing date of Jul. 10, 2017, which claims priority of GB Patent Application 1612401.8 filed Jul. 18, 2016 and EP Patent Application 16179949 filed Jul. 18, 2016. Each of these applications is herein incorporated by reference in their entirety for all purposes.

Field of the Invention

This invention relates generally to a lock and, more particularly but not necessarily exclusively, to a lock, particularly suitable for securing a tamper-resistant and/or tamper-evident cover.

BACKGROUND

Tamper-resistant/evident covers are well known in many fields for covering the internal elements and components of a device or system in a manner that deters unauthorised or forced removal of the cover and/or leaves a clear external indication that unauthorised or forced removal of the cover (or an attempt at such) has taken place.

In general, a tamper-resistant cover might comprise a closure mechanism or lock that requires a specially shaped/configured tool to effect authorised opening thereof. The closure mechanism or lock can only be opened, without force, by using the correct tool. However, the correct tool may be misplaced or otherwise not easily accessible when required for authorised opening. In addition, such tools can, in many circumstances, be replicated or improvised such that unauthorised opening of the closure mechanism or lock can still be effected, and the closure mechanism or lock can be re-closed by the same tool without leaving any form of evidence of tampering afterwards. If the closure mechanism/lock is opened by force, it suffers permanent damage and must be replaced.

Tamper-evident methods are known for covers and the like, whereby a frangible wire, connector or tape is used, which is affixed across the join between the cover and the main body with which it is associated such that, once the cover is opened or removed, the wire, connector or tape is permanently broken and thereby provides evidence that the cover has been opened and removed. However, such methods are not practical or appropriate in many different applications, such as mobile phone backs or vehicle panels, where the product on which the cover is provided is repeatedly and manually used and the wire, tape or connector could be broken simply through normal usage. Furthermore, such applications may require the cover to be removed periodically, by an authorised person, whereas once the cover is removed, even in legitimate circumstances, the tamper-evident mechanism is broken to spuriously indicate tampering. From the opposite perspective, if tampering has occurred, the tamper-evident mechanism can be relatively easily replaced with a new wire, connector or tape, such that it is no longer evident that tampering may have occurred.

SUMMARY

It is an object of aspects of the present invention to address at least some of these issues and, in accordance with a first aspect of the present invention, there is provided a tamper-resistant lock assembly comprising a plate having a slot for receiving a key, said slot extending through said plate from an opening in a front face thereof to an exit in an opposing rear face thereof, said opening having a first profile and said exit having a second, different profile, said key comprising a shaft having a bit extending therefrom, said bit being formed of a shape memory material and being pre-configured such that its cross-sectional shape in its temporary form matches said first profile and said bit can be inserted through said slot via said opening and, upon application of a predetermined external stimulus, returns to a permanent form in which its cross-sectional shape matches said second profile and said bit can be retracted from said slot via said exit.

In an exemplary embodiment, the inner profile of said slot substantially matches said first profile adjacent said opening and substantially matches said second profile adjacent said exit; and may morph from said first profile to said second profile along its length.

The shape memory material may comprise a shape memory plastic or polymer; and/or may be elastically deformable upon application of pressure.

In an exemplary embodiment, the shaft may comprise an elongate, substantially cylindrical member having a substantially conical end portion for easy alignment purposes, wherein said bit extends from said shaft at a location adjacent said end portion.

The external stimulus may be heat, although this will be dependent on the shape memory material used. In this case, the shaft may comprise or include a heat conductive core along its length to a location adjacent said bit.

The plate may include therein one or more apertures, grilles or ducts configured to enable said external stimulus to be applied to said bit from a location externally of said cover.

In an exemplary embodiment, the lock may comprise at least one heating device located adjacent said bit, said heating device being selectively operable to apply heat to said bit. In this case, the heating device may be wirelessly operable via a wireless tag or fob.

The above-mentioned first profile may, for example, be substantially rectangular and the above-mentioned second profile may be generally S-shaped.

The plate may comprise a cover including one or more fixing members for affixing said cover over an opening in a main body of a device, in which case, the lock may be configured such that when said key is fully inserted in said slot, said bit engages with said one or more fixing members and acts to prevent removal of said cover from said opening.

In an exemplary embodiment, the bit, in said deformed state, may be configured to provide a snap-fit or torsional engagement member to affix a cover over an opening in a main body of a device and wherein, in said permanent state, said bit can be retracted to release said cover and permit its removal from said opening.

In accordance with another aspect of the present invention, there is provided a key for use with a lock assembly substantially as described above, wherein said key comprises a shaft having a bit extending therefrom, said bit being formed of a shape memory material and being pre-configured such that its cross-sectional shape in its temporary form has a first profile and its cross-sectional shape in its permanent form has a second, different profile.

In accordance with yet another aspect of the present invention, there is provided a tamper-resistant enclosure assembly comprising a receptacle having an opening therein and a cover configured to, in use, close said opening, the receptacle including at least one locking plate having a first surface facing outwardly of said receptacle and a second, opposing surface, said locking plate having a slot extending therethrough from an opening in said first surface to an exit in said second surface, said opening having a first profile and said exit having a second, different profile, the assembly further comprising at least one key comprising a shaft having a bit extending therefrom, said key being mounted within an aperture extending through said cover from an outer face to an opposing inner face thereof such that said bit is adjacent said inner face, said bit being formed of a shape memory material and being pre-configured such that its cross-sectional shape in its temporary form matches said first profile and said bit can be inserted through said slot via said opening and, upon application of a predetermined external stimulus, returns to a permanent form in which its cross-sectional shape matches said second profile and said bit can be retracted from said slot via said exit.

BRIEF DESCRIPTION OF THE FIGURES

These and other aspects of the invention will be apparent from the following specific description, in which embodiments of the present invention are described, by way of examples only, and with reference to the accompanying drawings, in which.

DETAILED DESCRIPTION

Figure 1:
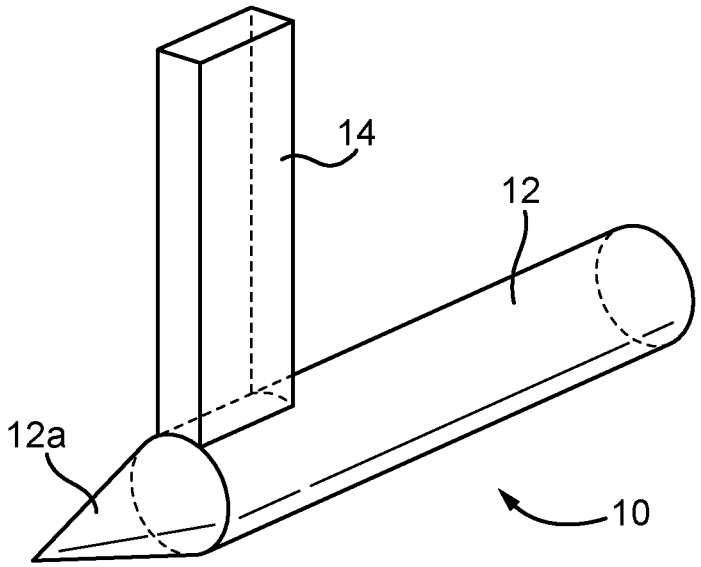
FIG. 1 is a schematic perspective view of a key for a lock according to an exemplary embodiment of the invention, with the bit illustrated in its temporary state.

Referring to FIG. 1 of the drawings, there is illustrated schematically a key 10 for a tamper-resistant/tamper-evident lock according to an exemplary embodiment of the present invention. The key 10 comprises an elongate, generally cylindrical shaft 12 having a substantially conical end portion 12*a* defining a pointed insertion end. Extending generally orthogonally from a circumferential wall portion of the shaft 12, adjacent to the conical end portion 12*a*, there is provided a bit 14 formed of a shape memory plastic or polymer (SMP), such as Desmopan® 2795A, which has a switching temperature of around 40° C. The shaft may be formed of the same shape memory material (in an undeformed state), such that the shaft 12 and the bit 14 can be formed integrally by means of a single manufacturing process (e.g. 3D printing). However, the shaft 12 does not need to have shape memory properties and, as such, can be formed of any suitable material, including a different form of plastic or polymer, or even metal.

Shape memory plastics or polymers, generally, are polymeric smart materials that have the ability to return from a deformed state (temporary shape) to their original (permanent) form or shape induced by an external stimulus (trigger), such as temperature change. In this case, the deformed state (temporary form) of the bit 14 has a first cross-sectional shape, which in this specific exemplary embodiment is generally rectangular.

Figure 2:
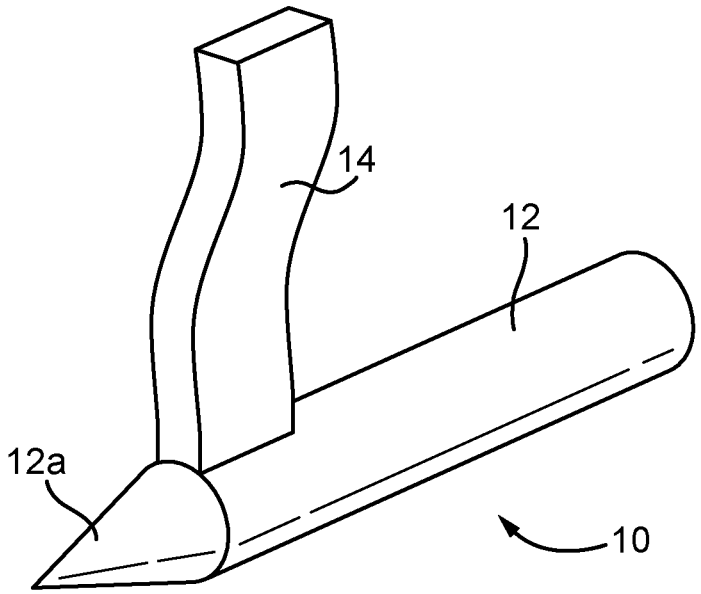
FIG. 2 is a schematic perspective view of the key of FIG. 1, with the bit illustrated in its permanent state.

Referring to FIG. 2 of the drawings, upon application of heat to the bit 14, to increase its temperature by a predetermined amount or to a predetermined level, the bit 14 returns to its original shape (permanent form), having a second, different cross-sectional shape which, in this specific exemplary embodiment of the invention, is of a generally shallow S-shape.

Figure 3:
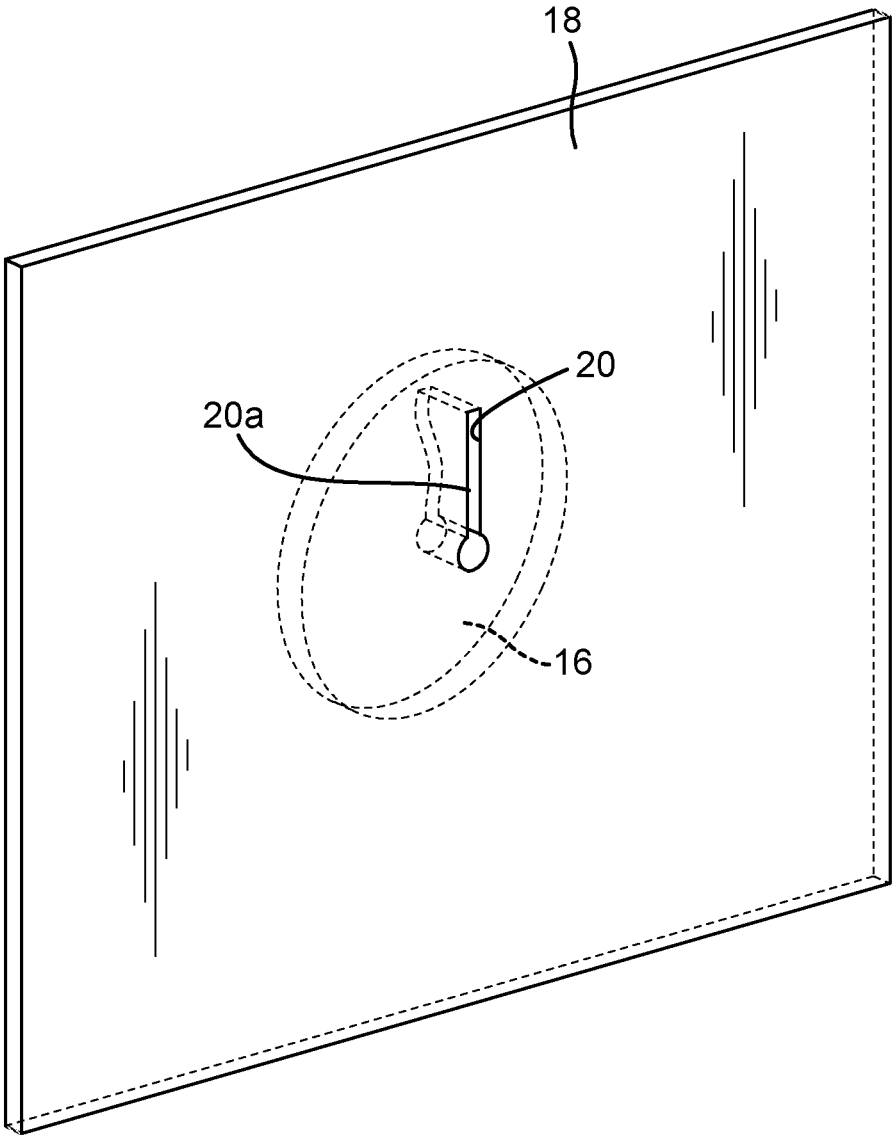
FIG. 3 is a schematic perspective view of a cover including a slot of a lock according to an exemplary embodiment of the present invention.
Figure 4:
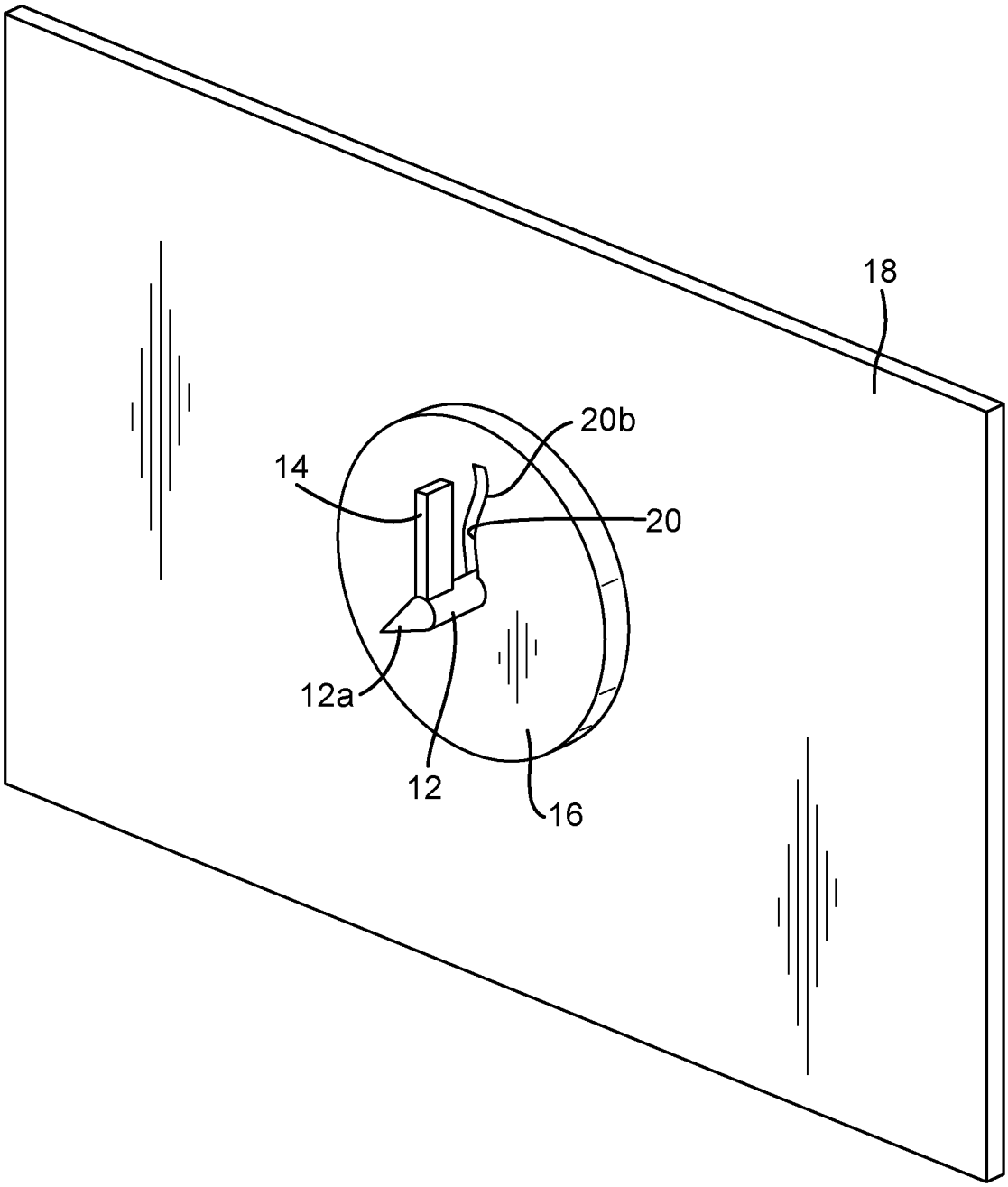
FIG. 4 is a schematic perspective view of the rear face of the cover of FIG. 3, with the key of FIG. 1, in its temporary state, inserted therethrough.

Referring to FIG. 3 of the drawings, a cover 16 may be configured to be inserted and affixed within an aperture in a panel or wall 18. The cover 16 is provided with a slot 20 therethrough, extending from an opening 20*a* in the front (external) face of the cover 16 to an exit (20*b*—FIG. 4) in the rear (internal) face of the cover 16. The profile of the opening 20*a* substantially matches the cross-sectional shape of the key 10 (including the shaft 12 and the bit 14) when the bit 14 is in the above-mentioned deformed state, whereas, as shown in FIG. 4 of the drawings, the profile of the exit 20*b* substantially matches the shape of the key 10 (again, including the shaft 14 and the bit 14) when the bit 14 is in the above-mentioned permanent state. The inner profile of the slot 20 (i.e. its side walls and edges), between the opening 20*a* and the exit 20*b*, morphs (i.e. transform or taper substantially smoothly and gradually) from the profile of the side walls of the opening 20*a* to the profile of the side walls of the exit 20*b*.

Figure 6:
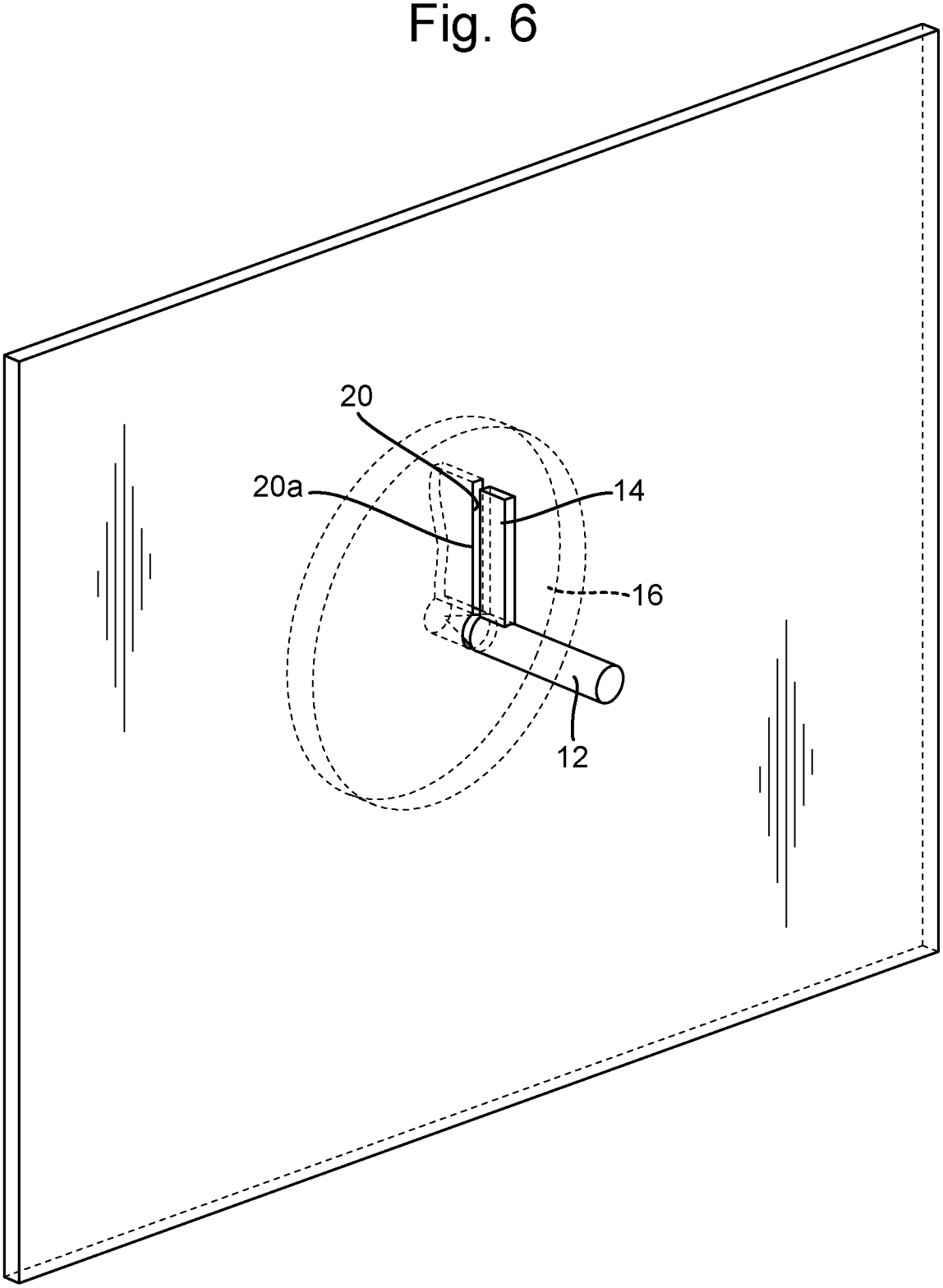
FIG. 6 is a schematic perspective view of the front face of the cover of FIG. 3, illustrating the key of FIG. 1, in its temporary state, being inserted through the opening.

Referring to FIG. 6 of the drawings, to lock the cover within the above-mentioned aperture in the panel or wall 18, the cover 16 is mounted and affixed therein, as will be described in more detail hereinafter, such that the opening 20*a* of the slot 20 is externally facing. The key 10, with the bit 14 in the deformed state, is inserted into the slot 20 via the opening 20*a*, wherein the conical end portion 12*a* provides for easier alignment of the key. The shape memory polymer (SMP) has a certain amount of elastic deformability upon application of pressure. Thus, the bit 14 can be pushed through the slot 20 and the exit 20*b* simply by elastic deformation thereof by a manual pushing force applied to the end of the shaft 12 of the key 10. Once the key 10 has been fully inserted through the slot 20, such that the bit 14, in the deformed state, has cleared the exit 20*b* at the rear of the cover 16, it cannot be retracted because of a mis-match between the cross-sectional shape of the bit 14 in the deformed state and the profile of the exit 20*b* of the slot 20.

In an exemplary embodiment of the present invention, the bit 14 may actually form a non-reciprocal barb-like fixing member for engagement with a peripheral feature at the opening in the panel or wall 18, such that the cover can be affixed over the opening by means of a snap-fit engagement, as will be described hereinafter in relation to FIGS. 7 to 10 of the drawings, or even torsional engagement (by turning the key 10 in the slot 20 when it is fully inserted therethrough) with the peripheral feature (e.g. a peripheral flange or the like). Whilst in the temporary, deformed state, the bit 14 acts to hold the cover in place over the opening, but when heat is applied and the bit 14 returns to its permanent form, it can be pulled away (or it may be configured to retract) from the peripheral edge of the opening to release the cover and allow it to be removed. In other exemplary embodiments, the bit 14 may engage with a separate fixing mechanism or engagement means that holds the cover in place over the opening, whereby removal of the key from the slot (after heating the bit 14 and returning it to its permanent form as described above) releases the fixing mechanism and allows the cover 16 to be removed from the opening.

Figure 5:
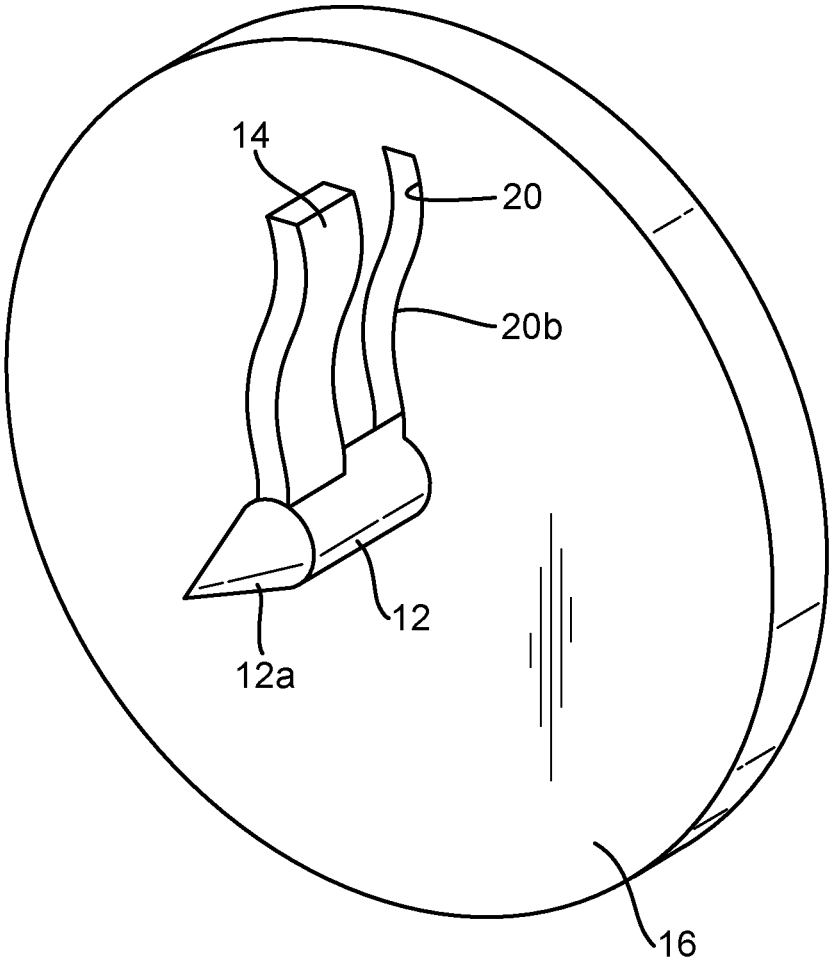
FIG. 5 is a schematic perspective view of the rear face of the cover of FIG. 3, with the key of FIG. 2, in its permanent state, inserted therethrough.

If it is required to remove the cover 16, heat can be applied to the bit 14, so as to cause it to return to its permanent state, in which the cross-sectional shape matches the profile of the exit 20*b*, as shown in FIG. 5 of the drawings. There are a number of ways in which heat could be applied to the bit 14 for this purpose, and the present invention is not necessarily intended to be limited in this regard. For example, a heat conductive (e.g. metallic) core may be provided longitudinally through the shaft, such that application of heat at an end thereof would cause the bit 14 to be heated thereby. Alternatively, one or more small holes, ducts or grilles may be provided in the cover 16 to enable a heat gun, or similar device, to be used to deliver heat to the bit 14 directly through the holes/ducts/grilles. In yet another exemplary embodiment, a small, self-powered, wirelessly operable heating device may be provided at or adjacent the rear of the cover 16, which is operable externally of the cover by a wireless tag or fob to heat the bit 14, thereby further increasing the degree of tamper-resistance of the lock.

Irrespective of the manner in which heat is applied to the bit 14 to return it to its permanent form, in this state, the key 10 can be retracted through the slot 20 and pulled out through the opening 20*a*, thereby unlocking the cover 16 and enabling its removal. Of course, once the bit 14 has been returned to its permanent state by the application of heat thereto (or, in other exemplary embodiments, utilising different shape memory materials, by the application of some external stimulus or trigger thereto), it can only be re-formed to its deformed state using specialist tooling/techniques, dependent largely on the shape memory material used and the cross-sectional shape of the deformed state. Thus, once the key 10 is removed from the slot 20, the fact that the cover has been removed will be immediately evident externally, as the key cannot be re-inserted into the slot 20 and its absence, therefore, makes it immediately evident that removal or 'tampering' has taken place. It is envisaged that, following authorised removal of the cover 16, the bit 14 would either be re-formed to the deformed state by means of the above-mentioned specialist tooling/techniques, and the key then re-inserted into the slot 20, or the key 10 could be entirely discarded and replaced with a new one.

Figure 7:
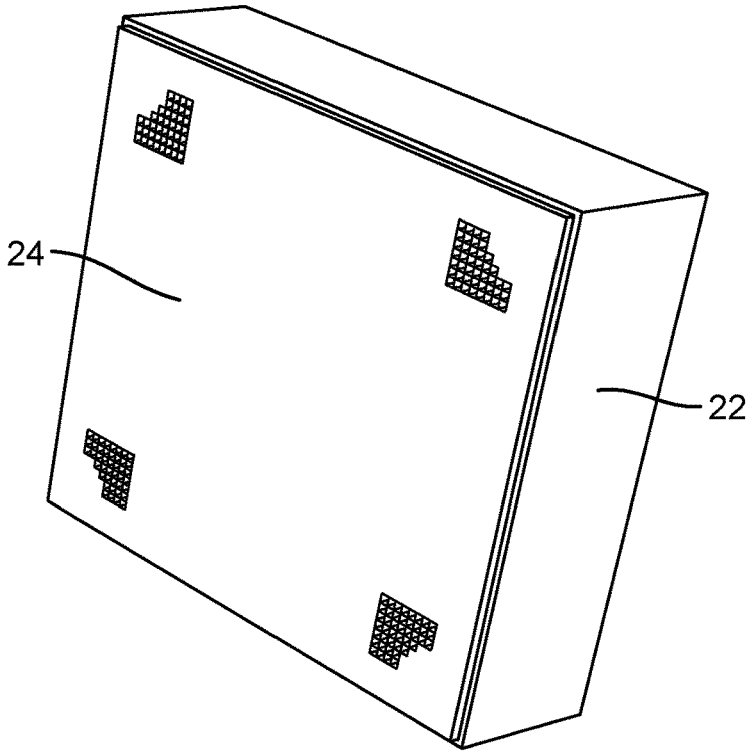
FIG. 7 is a schematic perspective view of a tamper-resistant box according to an exemplary embodiment of the present invention.
Figure 8:
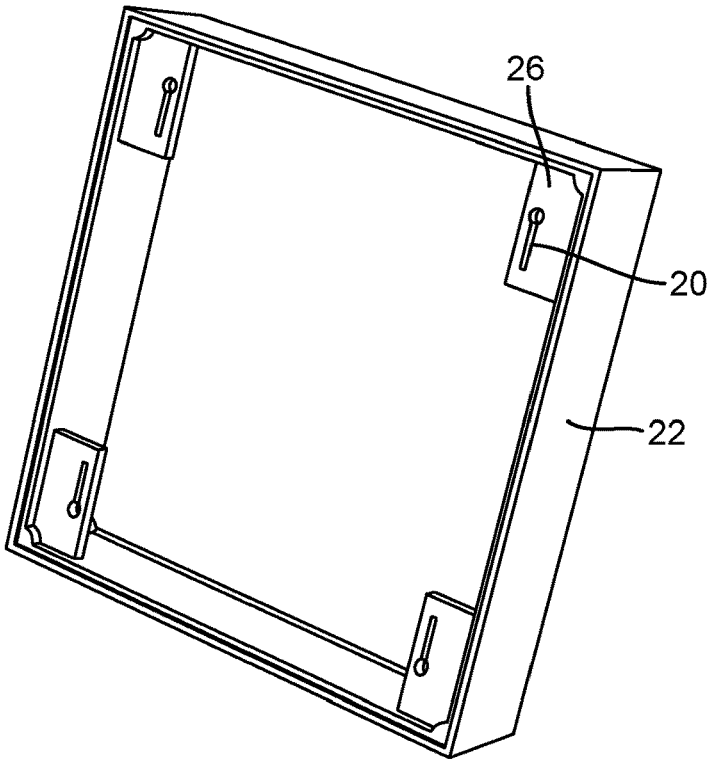
FIG. 8 is a schematic perspective view of the box of FIG. 7 with the cover removed.

Referring to FIG. 7 of the drawings, there is illustrated schematically a box 22 having a cover 24 and a tamper-resistant locking assembly of the type described above. As illustrated schematically in FIG. 8 of the drawings, the box 22 (with the cover removed) comprises an open, generally rectangular receptacle, and the cover 24 is shaped and configured to fit over the open end of the receptacle to close the box 22, when in use. However, it will be appreciated that the box 22 may be of any shape and/or size required by a specific application, and it may have a completely open end, as illustrated, or it may be partially closed with an aperture therein, wherein the cover 24 is simply shaped and configured to fit over the aperture to close the box 22. It is to be understood that the present invention is in no way intended to be limited with regard to the shape and/or configuration of the box and/or the cover. Indeed, the 'box' may even be a recess or cabinet portion within a larger structure.

Referring back to FIG. 8 of the drawings, a locking plate 26 is provided at or adjacent each of the inner corners of the box 22, close to the open end, wherein the principal plane of each of the locking plates 26 is oriented substantially parallel to the plane defined by the open end of the box 22. Each locking plate 26 has a slot 20 defined therein, of the type defined above. Thus, each slot 20 has a first profile at the outer surface of the respective locking plate 26, and a second profile at the respective inner surface.

Figure 9:
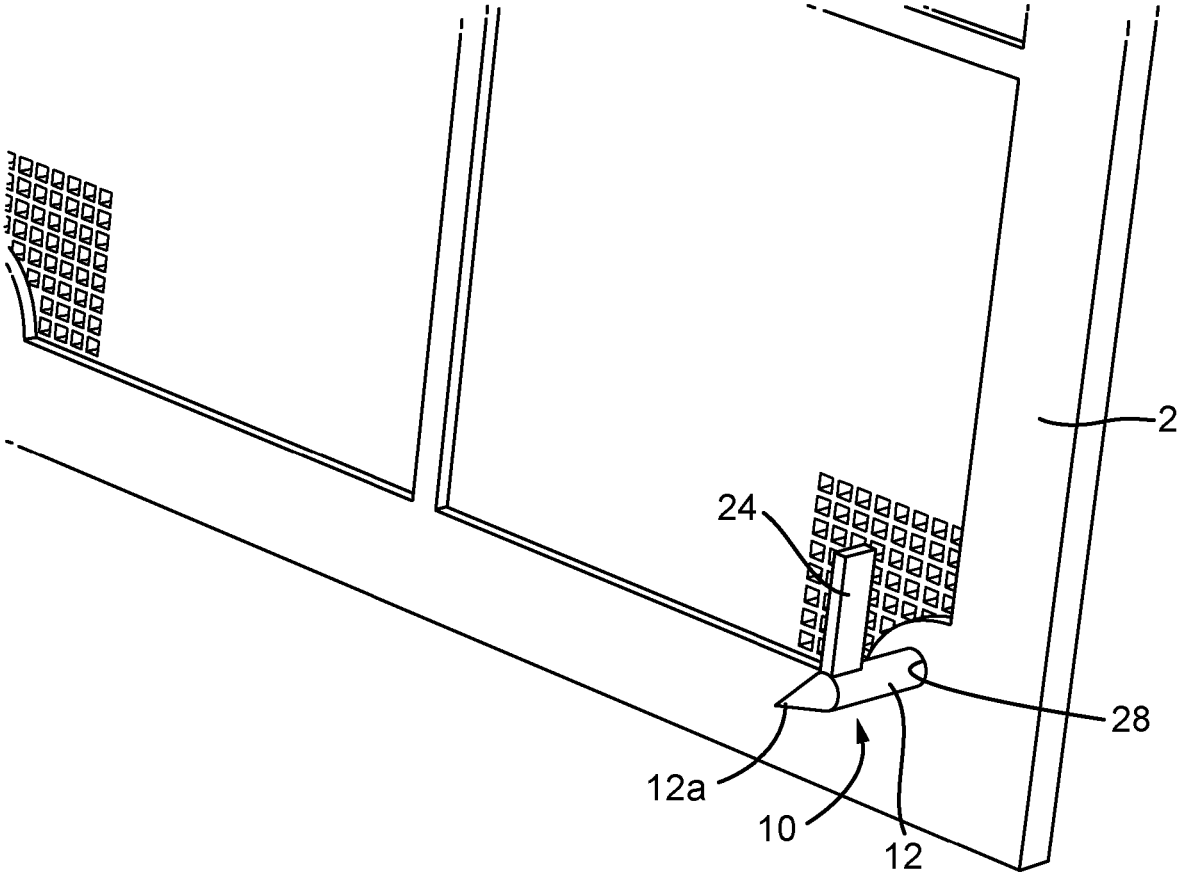
FIG. 9 is a schematic partial close-up view of an inner face of the cover of the box of FIG. 7, illustrating the key with the bit in its temporary state.
Figure 10:
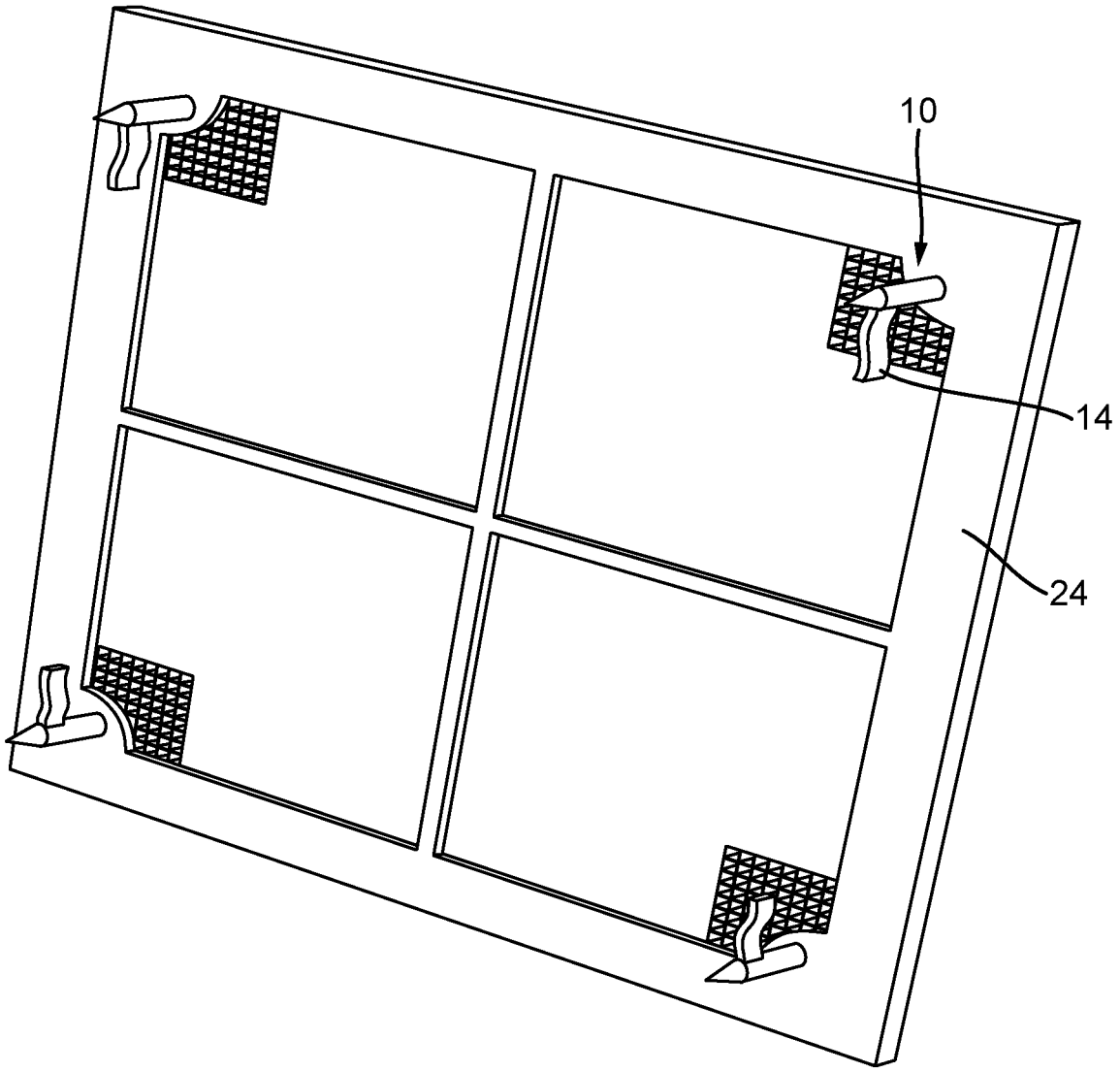
FIG. 10 is a schematic perspective view of an inner face of the cover of FIG. 9, illustrating the keys with their respective bits in their permanent state.

Referring now to FIG. 9 of the drawings, a key 10 of the type described above is provided at each of the four corners of the cover 24, with each key 10 being mounted within a respective aperture 28 in the cover 24, wherein the diameter of each aperture 28 substantially matches that of the shaft 12 of the respective key 10 mounted therein. Prior to mounting the cover 24 over the open end of the box 22, the bit 14 of each key 10 is in its deformed (temporary) state (that matches the above-mentioned first slot profile), with the conical end portion 12*a* and the bit 14 protruding through the aperture 28 on the inner face of the cover 9 i.e. the face of the cover that will be facing into the receptacle defined by the box 22 when the cover 24 is fitted thereon). In this configuration, the cover 24 can be fitted over the open end of the box 22, with the conical end portion 12*a* and bit 14 of each key 10 being lined up with a respective slot 20 in the locking plates 26 of the box 22. A user can apply a manual force to the cover, toward the box 22, to force the bits 14 of the keys 10 through their respective slots 20, thereby locking the cover 24 in place over the open end of the box 22. As the profile of each bit 14 in its temporary state does not match the profile of the respective slot at the inner surface of the locking plate 26, it cannot be retracted back through the slot 20, and the cover cannot, therefore, be removed. If it is required to remove the cover 24 from the box 22, an external stimulus (such as heat in the above-mentioned example) must be applied, to return each bit 14 to its permanent state (matching the profile of the respective slot 20 at the inner surface of the locking plate 26, as shown in FIG. 10 of the drawings, so that the keys 10 can be retracted and allow the cover to be removed.

Thus, exemplary embodiments of the present invention provide a tamper-resistant and/or tamper-evident lock that has a number of advantages associated therewith when compared with prior art assemblies. Firstly, heat (or another external stimulus) is required to remove the key: this cannot readily be achieved by force, which acts as a deterrent to unauthorised removal. The key cannot be re-inserted unless a specialist tool/technique is used to reform the bit to its deformed state. Thus, once the key has been removed, tampering is immediately and permanently evident. Overall, therefore, the lock acts as a deterrent to unauthorised removal but, if unauthorised removal thereof has taken place, this is immediately (externally) and permanently evident.

It will be apparent to a person skilled in the art, from the foregoing description, that modifications and variations can be made to the described embodiments, without departing from the scope of the invention as defined by the appended claims.

The invention claimed is:

1. A tamper-resistant lock and key assembly comprising:

a plate having a slot for receiving a key, said slot extending through said plate from an opening in a front face thereof to an exit in an opposing rear face thereof, said opening having a first profile and said exit having a second, different profile, said key comprising a shaft having a bit extending therefrom, said bit being formed of a shape memory material and being pre-configured such that its cross-sectional shape in its temporary form matches said first profile and said bit can be inserted through said slot via said opening and, upon application of a predetermined external stimulus, returns to a permanent form in which its cross-sectional shape matches said second profile and said bit can be retracted from said slot via said exit.

2. The lock assembly according to claim 1, wherein the inner profile of said slot substantially matches said first profile adjacent said opening and substantially matches said second profile adjacent said exit.

3. The lock assembly according to claim 2, wherein said inner profile of said slot morphs from said first profile to said second profile along its length.

4. The lock assembly according to claim 1, wherein said shape memory material is a shape memory plastic or polymer.

5. The lock assembly according to claim 1, wherein said shape memory material is elastically deformable upon application of pressure.

6. The lock assembly according to claim 1, wherein said shaft comprises an elongate, substantially cylindrical member having a substantially conical end portion, wherein said bit extends from said shaft at a location adjacent said end portion.

7. The lock assembly according to claim 1, wherein said external stimulus is heat.

8. The lock assembly according to claim 7, wherein said shaft comprises or includes a heat conductive core along at least a portion of its length to a location adjacent said bit.

9. The lock assembly according to claim 1, wherein said plate includes therein one or more apertures, grilles or ducts configured to enable said external stimulus to be applied to said bit from a location externally of said cover.

10. The lock assembly according to claim 7, further comprising at least one heating device located adjacent said bit, said heating device being selectively operable to apply heat to said bit.

11. The lock assembly according to claim 10, wherein said heating device is wirelessly operable via a wireless tag or fob.

12. The lock assembly according to claim 1, wherein said plate comprises a cover including one or more fixing members for affixing said cover over an opening in a main body of a device, said lock being configured such that when said key is fully inserted in said slot, said bit engages with said one or more fixing members and acts to prevent removal of said cover from said opening.

13. The lock assembly according to claim 1, wherein said bit, in said deformed state, is configured to provide a snap-fit or torsional engagement member to affix a cover over an opening in a main body of a device and wherein, in said permanent state, said bit is retracted to release said cover and permit its removal from said opening.

14. A tamper-resistant enclosure assembly comprising:

a receptacle having an opening therein; and a cover configured to, in use, close said opening, wherein the receptacle includes at least one locking plate having a first surface facing outwardly of said receptacle and a second, opposing surface, wherein said locking plate further comprises a slot extending therethrough from an opening in said first surface to an exit in said second surface, said opening having a first profile and said exit having a second, different profile, the assembly further comprising at least one key comprising a shaft having a bit extending therefrom, wherein said key is mounted within an aperture extending through said cover from an outer face to an opposing inner face thereof, such that said bit is adjacent said inner face, and wherein said bit is formed of a shape memory material and is pre-configured such that its cross-sectional shape in its temporary form matches said first profile and said bit can be inserted through said slot via said opening and, upon application of a predetermined external stimulus, returns to a permanent form in which its cross-sectional shape matches said second profile and said bit can be retracted from said slot via said exit.

15. The lock assembly according to claim 2, wherein said shape memory material is elastically deformable upon application of pressure.

16. The lock assembly according to claim 3, wherein said shape memory material is elastically deformable upon application of pressure.

17. The lock assembly according to claim 4, wherein said shape memory material is elastically deformable upon application of pressure.

18. The lock assembly according to claim 2, wherein said shaft comprises an elongate, substantially cylindrical member having a substantially conical end portion, wherein said bit extends from said shaft at a location adjacent said end portion.

19. The lock assembly according to claim 3, wherein said shaft comprises an elongate, substantially cylindrical member having a substantially conical end portion, wherein said bit extends from said shaft at a location adjacent said end portion.

* * * * *